United States Patent [19]

Gieske, Jr.

[11] 4,233,808

[45] Nov. 18, 1980

[54] TOBACCO TYING PRODUCT

[76] Inventor: Edward T. Gieske, Jr., Chattolanee Hill, Owings Mills, Md. 21117

[21] Appl. No.: 31,137

[22] Filed: Apr. 18, 1979

[51] Int. Cl.[3] ..... D02G 3/02; D02G 3/44; A24B 3/14

[52] U.S. Cl. ..... 57/200; 57/28; 57/260; 131/1

[58] Field of Search ..... 57/4, 28–32, 57/200, 210, 236, 238, 252, 256, 258, 259, 260; 131/1, 15 R, 15 C, 17 R, 17 A, 17 AE

[56] References Cited

U.S. PATENT DOCUMENTS

| | | | |
|---|---|---|---|
| 524 | 12/1837 | Smith | 57/28 |
| 412,963 | 10/1889 | Lowry | 57/210 |
| 679,695 | 7/1901 | Ellis | 57/200 |
| 708,172 | 9/1902 | Schertiger | 57/30 |
| 891,935 | 6/1908 | Jerrems | 57/238 |
| 1,150,136 | 8/1915 | Lowry | 57/200 |
| 1,163,763 | 12/1915 | Lowry | 57/28 X |
| 2,128,929 | 9/1938 | Estes | 57/200 |

*Primary Examiner*—John Petrakes

*Attorney, Agent, or Firm*—Cushman, Darby & Cushman

[57] ABSTRACT

A twine suitable for tying tobacco leaves together and consisting essentially of stalks and/or leaf stems of tobacco plants.

6 Claims, No Drawings

TOBACCO TYING PRODUCT

BACKGROUND OF THE INVENTION

The present invention relates to a twine, cord or the like formed from portions of tobacco plants and suitable for tying a group of tobacco leaves together.

After tobacco is harvested and cured, the farmer strips the leaves from the stalks. With certain types of tobacco, for example, that produced in Maryland as well as Kentucky and Tennessee-produced burley, the cured leaves are dry, fluffy and friable. Therefore, to avoid degradation losses and inconvenience in handling and transporting such leaves, they are tied in bundles called "hands". The conventional manner of doing this is to use another tobacco leaf as the tying element. This is so because the tied leaves are ultimately threshed, and it is absolutely essential to insure that no foreign substances such as string, rubber bands or the like contaminate the threshed tobacco. If non-tobacco tying means were employed in forming hands of tobacco leaves, it would be necessary to provide some means for insuring that the tying material was completely separated from the leaves before threshing. Of course, this would add a significant operational cost and problem to the preparation of the finished tobacco.

Inasmuch as the farmer preparing hands of tobacco has found it necessary in producing a salable product to use a tie leaf instead of twine, he has not been able to avail himself of conventional tying machines. Instead, he has had to perform the tedious and time-consuming tying operation by hand. It has been estimated that the elimination of this hand operation could save the farmer up to 20% of his production cost. Additionally, if machines could be used to tie hands of tobacco, the hands could be formed of substantially uniform size so as to facilitate the customary step of severing the hand ties as the tobacco is introduced into the thresher.

The present invention is concerned with the solution of the tying problem just discussed. More particularly, the shortcomings of the conventional tobacco tying technique can be overcome by the use of a twine formed from tobacco itself.

Such an approach heretofore has not been considered. Tobacco leaves lack the physical properties which are necessary to form a twine, string, cord or the like, having sufficient strength to be used in a tying machine to secure tobacco leaves together.

In the process of reconstituting tobacco products, efforts have been made in the past to produce tobacco products with improved physical properties. Such efforts have taken the form of combining tobacco leaves and stalks within a sheet. This product is commonly called homogenized tobaco leaf (HTL). The resultant product has greater strength than a sheet made solely from tobacco leaves since the fiber content which is contributed by the stalks supplement those of the stems and veins of the leaves. However, there has been no recognition that a suitable twine may be formed substantially entirely from the relatively inexpensive stalks and/or stems of tobacco plants. This may in part be due to the fact that such portions of the plant may be acrid when burned, and therefore their use in substantial quantities has been avoided to insure that they are not introduced into cigarettes, cigars and the like.

SUMMARY OF THE INVENTION

The present invention involves the fabrication of a tobacco twine, cord or the like from the stalks and/or the leaf stems of tobacco plants.

DETAILS OF THE INVENTION

In accordance with the invention, a twine is fabricated using as the principal components tobacco stalks, the stems (and veins) of tobacco leaves, or mixtures thereof. More particularly, in the preferred embodiment of the invention, the fibrous portions of tobacco plants, namely stalks and/or leaf stems and veins (which are conventionally separated from the tissue portion of tobacco leaves during the threshing process), are chopped into segments of suitable length, and a sheet or web of tobacco is formed from these segments using techniques well known in the HTL art. The sheet or web thus formed is then processed to make a twine, cord or the like, using substantially the same method commonly employed in making Kraft paper twine.

The resultant product is one which has high strength properties due to the presence of fibers from the tobacco stalks, stems and/or veins. The tobacco twine is suitable for use by a tobacco farmer with conventional tying machines to tie hands of tobacco leaves.

When such hand ties are severed prior to threshing, they can be retrieved with the leaf stems and veins either to be reformed into twine or included in other tobacco by-products.

What is claimed is:

1. A product suitable for use in tying tobacco leaves together, said product comprising a twine formed from a web consisting essentially of fibrous portions of tobacco plants and substantially exclusive of tissue portions of the plants.

2. A product as set forth in claim 1, wherein said fibrous portions are tobacco stalks.

3. A twine as set forth in claim 1, wherein said fibrous portions are stems of tobacco leaves.

4. A twine as set forth in claim 1, wherein said fibrous portions are a mixture of stems and veins of tobacco leaves.

5. A twine as set forth in claim 1, wherein said fibrous portions are a mixture of tobacco stalks and stems of tobacco leaves.

6. A twine as set forth in claim 5, wherein said mixture further includes veins of tobacco leaves.

* * * * *